US006253935B1

(12) United States Patent
Fletcher

(10) Patent No.: US 6,253,935 B1
(45) Date of Patent: Jul. 3, 2001

(54) ARTICLES, SUCH AS A NIPPLE, A PACIFIER OR A BABY'S BOTTLE

(75) Inventor: Timothy Pinckney Fletcher, Raleigh, NC (US)

(73) Assignee: Konstantin Anagnostopoulos, Dr.Sc., Greifensee (CH)

( * ) Notice: Subject to any disclaimer, the term of this patent is extended or adjusted under 35 U.S.C. 154(b) by 0 days.

(21) Appl. No.: 09/421,689

(22) Filed: Oct. 20, 1999

(51) Int. Cl.[7] ..... A61J 9/00; A61J 11/00; A61J 13/00; A61J 17/00

(52) U.S. Cl. ..... 215/11.1; 215/11.5; 604/78; 606/236

(58) Field of Search ..... 215/11.1, 11.5, 215/11.6; 604/78; 606/236

(56) References Cited

U.S. PATENT DOCUMENTS

| | | | | |
|---|---|---|---|---|
| 1,099,082 | * | 6/1914 | Decker | 215/11.1 |
| 1,999,581 | * | 4/1935 | Yager | 215/11.5 |
| 2,517,457 | * | 8/1950 | Allen | 215/11.3 |
| 2,588,069 | * | 2/1952 | Allen | 215/11.1 |
| 2,796,062 | * | 6/1957 | Tupper | 215/11.1 X |
| 4,586,621 | * | 5/1986 | Dahan | 215/11.1 |
| 5,049,126 | * | 9/1991 | Larson | 604/78 |
| 5,108,686 | * | 4/1992 | Griffin | 215/11.1 X |
| 5,653,732 | * | 8/1997 | Sheehy | 215/11.1 X |
| 5,690,679 | * | 11/1997 | Prentiss | 215/11.6 X |
| 5,885,246 | * | 3/1999 | Ford | 604/78 |
| 5,993,479 | * | 11/1999 | Prentiss | 215/11.6 X |
| 5,994,450 | | 11/1999 | Pearce . | |
| 6,032,810 | * | 3/2000 | Meyers et al. | 215/11.5 X |
| 6,073,788 | * | 6/2000 | Stroud | 215/11.5 X |

FOREIGN PATENT DOCUMENTS

514745 * 7/1955 (CA) ..... 215/11.1

OTHER PUBLICATIONS

Policy Statement—Breast Feeding and the Use of Human Milk (RE9729), American Academy of Pediatrics, vol. 100, No. 6, Dec., 1997, pp. 1035–1039.

"Sucking Technique and its Effect on Success of Breastfeeding," *Birth,* 19:4, L. Righard and M. O. Alade, Dec. 1992, pp. 185–189.

"Nipple Confusion: Toward a Formal Definition" —J. Pediatr., M. Neifert, R. Lawrence, and J. Seacat, 1995, pp. S125–S129.

Nachr. Chem. Techm., 20 (1972), Nr. 4, p. 70 Partial Translation First 2 Paragraphs.

* cited by examiner

*Primary Examiner*—Sue A. Weaver
(74) *Attorney, Agent, or Firm*—Arnold B. Silverman; Debra Z. Anderson; Eckert Seamans Cherin & Mellott, LLC

(57) ABSTRACT

An article intended to be contacted with a baby's mouth when sucking, or in form of a breast hood, the article comprises a wall at least part of a surface of it including a material which is able to be stretched at least twice in dimension under a tension corresponding to a suction force of at least 130 mm Hg. This article may be realized in the form of a combination of a baby's bottle and an assigned nipple. The baby's bottle may further comprise an outer surface to be gripped which is made at least in part from a second material having a predetermined elasticity and bulging out from the rigid material of the bottle.

32 Claims, 6 Drawing Sheets

ARTICLES, SUCH AS A NIPPLE, A PACIFIER OR A BABY'S BOTTLE

FIELD OF THE INVENTION

The present invention relates to articles used for feeding babies.

BACKGROUND OF THE INVENTION

In a "Policy Statement" in PEDIATRICS, vol.100, No. 6, of December 1997, pp. 1035–1039, the American Academy of Pediatrics emphasized the benefits of breasffeeding babies (human milk) over bottle feeding (such as cow milk). This article contains also a vast number of references showing the better health of babies fed with breastmilk. However, some problems either on the mother's side or on the baby's side or both can prevent successful breastfeeding (see Righard L, Alade M O, "Sucking technique and its effect on success of breastfeeding", *Birth,* 1992; 19; pp.185–189 or Neifert M, Lawrence R, Seacat J, "Nipple confusion: toward a formal definition" *J. Pediatr.,* 1995, 126, pp.125–129). Meanwhile, the term "nipple confusion" became known for a phenomenon which is based on different suction "techniques" a baby has to apply when sucking at the breast or from a bottle. Since a baby grasps relations to a wide extent with the mouth, it cannot differentiate between a nipple of a breast and that of a bottle. However, sucking on a breast requires a different technique, more comparable with milking a cow's udder which is concurrently pressed and stroked along, than sucking a bottle's nipple (where milk comes out with much less effort). In this way, a baby fed too much by a bottle can forget how to suck a breast. Of course, according to the above "Policy Statement", this leads to a loss of immune defense of the baby and, thus, it is easier subject to illnesses and diseases.

To avoid this "nipple confusion", some hospitals have begun feeding breast milk with a spoon, in case the mother has not enough milk herself. This is to avoid sucking from a bottle's nipple, but is, of course, very troublesome. Therefore, the problem exists as to how to feed a baby when the mother is not available for some reason or has not sufficient milk for her own.

SUMMARY OF THE INVENTION

Therefore, it is an object of the present invention to avoid "nipple confusion" in a less troublesome way.

The present inventor found in a first step toward the present invention that, although bottle feeding is very much less troublesome, it is just the cause of "nipple confusion"; the concept, therefore, should be to make bottle feeding as closely similar for the baby to breastfeeding as possible.

According to a first aspect of the present invention, this "assimilation" of bottle feeding to breasffeeding is made by using an article intended to be contacted with a baby's mouth when sucking which article can be e.g. a pacifier or a bottle's nipple. Such article comprises a wall with a surface at least at one side, where at least this surface includes a material able to be stretched at least twice in dimension under a tension corresponding to a suction force of at least 130 Hg. This solution of the problem is based on an analysis of the baby's sucking technique at a breast and the finding that the breast is able to be stretched in this way.

In average babies apply a suction force that corresponds to 150 to 200 Hg. Materials which meet this requirement (in addition to sanitary requirements to be able to keep the article clean) are rather rare, but can be found, for example, among the so-called thermo-elastics which are described, e.g. in *Nachr. Chem. Techn.,* 20 (1972), p. 70. This material can be stretched, according to its composition, to twice or even a multiple of its original dimension, nevertheless having a high tensional strength, a high elasticity module and a good rebound elasticity so as to assume the original size and shape as soon as the tension is relieved. An especially preferred material is sold by TekSource, Draper, UT 84020, under the brand name Gelastic. It is a combination with a colloidal material gel, thus making the material's properties particularly similar to that of the human skin, at least as far it is required in the present context. A detailed description is in U.S. patent application, Ser. No. 08/783, 413.

According to a second aspect of the present invention a baby's bottle nipple is formed in the shape of a mother's breast including a nipple portion. This takes into account to the finding that baby's palate is intentionally made by nature to adapt to the shape of a human breast. This aids in sucking (because it seals against by-passing air) and, moreover, avoids any deformation of the palate which may occur when the baby cannot suck in a natural manner.

Although both aspects mitigate alone the problem of "nipple confusion", it is clear that in a preferred embodiment of the present invention they are combined.

It is clear that forming a nipple in the shape of a breast is difficult in that a usual baby's bottle has a neck onto which the nipple is drawn to be fastened to it. Therefore, according to a third aspect of the present invention, a combination of a baby's bottle and an assigned nipple is provided. The baby's bottle comprises an opening of a predetermined size surrounded by an edge of the bottle's wall which is the fastening edge for the nipple. The nipple includes a fastening rim connected to that wall portion formed in the shape of a mother's breast of a predetermined circumference. In this case, the predetermined size of the bottle's opening corresponds substantially to the predetermined circumference of the breast wall portion so that a relative large breast can be formed and directly attached to the bottle's opening, e.g. via a fastening bulge of the bottle's edge.

Although it would be possible to have a bottle of oval cross-section in this particular combination, it is useful if the bottle's wall substantially cylindrical and has a circular cross-section) and/or if its inner surface is substantially without any recess and projection, because in this way, in addition to the benefit mentioned above, the bottle is easier to clean and to maintain hygienic conditions. If the walls of the bottle diverge towards the opening where the nipple is to be attached, the breast-shaped nipple can be formed in a more natural way without making a filled bottle too heavy.

A fourth aspect of the present invention is based on observing how babies hold on to mother's breast when sucking. In order to give them the familiar feeling, a baby's bottle comprises an inner surface of a first, rigid material which surrounds a cavity to be filled with liquid, such as breastmilk, and an outer surface to be gripped. The outer surface is made at least in part from a second material having a predetermined elasticity and bulging out from said first, rigid material. Since the materials mentioned above give a particular "skin-feeling", it is preferred if a thermo-elastic material is used, e.g. having the tensional strength and elasticity as defined above. In any case, the elastic bulge has the additional advantage that it prevents the bottle of slipping out of the feeding nurse, because at the moment when slipping begins, the diameter of the bulge is increased, thus forming a kind of a stop in the hand of the nurse. In this respect, this embodiment has a wider use for other bottles too, not only for baby's bottles.

This "skin-feeling", however, is also beneficial on the side of the mother when milk is pumped off. Therefore, according to a fifth aspect of the present invention, it is provided that a breast hood to be connected to a milk pump comprises an inner surface of thermo-elastic material preferably with the tensional strength and elasticity as defined above.

In cases of a bottle of an outer elastic material and an inner rigid material, or vice-versa in the case of a breast hood, the two materials could be cemented together. This, however, has some drawbacks, and it is, therefore, preferred if the two materials are formed together in a co-injection molding process. Such a process where different plastic materials are fed both into a common cavity of a mold has been described, for example, by Lemmelson.

BRIEF DESCRIPTION OF THE DRAWINGS

Further details and advantages will become apparent from the following description of embodiments schematically shown in the drawings in which:

FIG. 1 is an exploded perspective view of a baby's bottle and nipple combination according to the present invention of which FIGS. 3*a* to 3*c* are different perspective views of the nipple, while

DETAILED DESCRIPTION OF THE DRAWINGS

Figure 2:
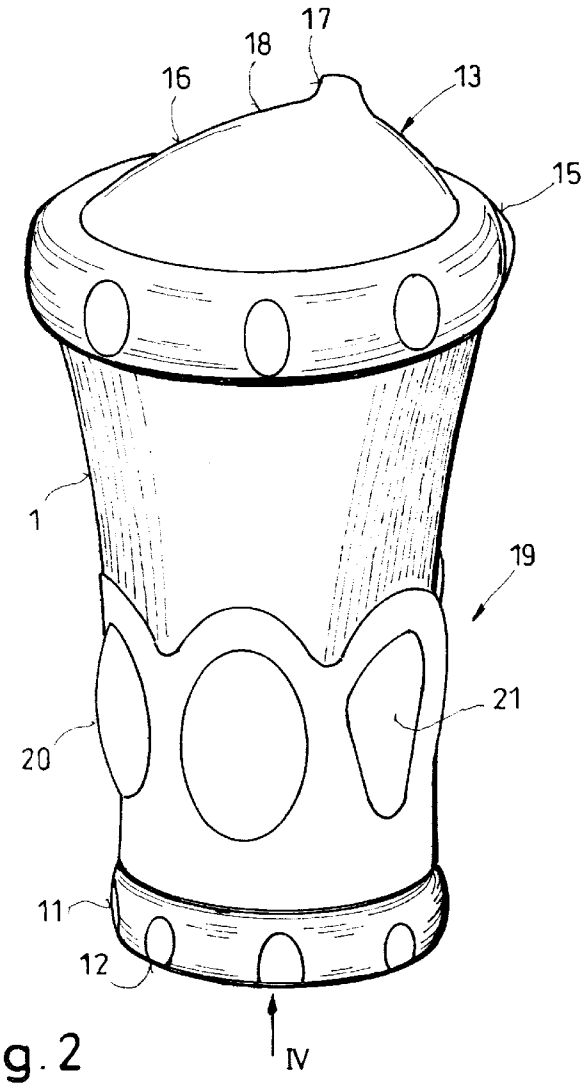
FIG. 2 is a somewhat enlarged perspective view of the combination when assembled.
Figure 1:
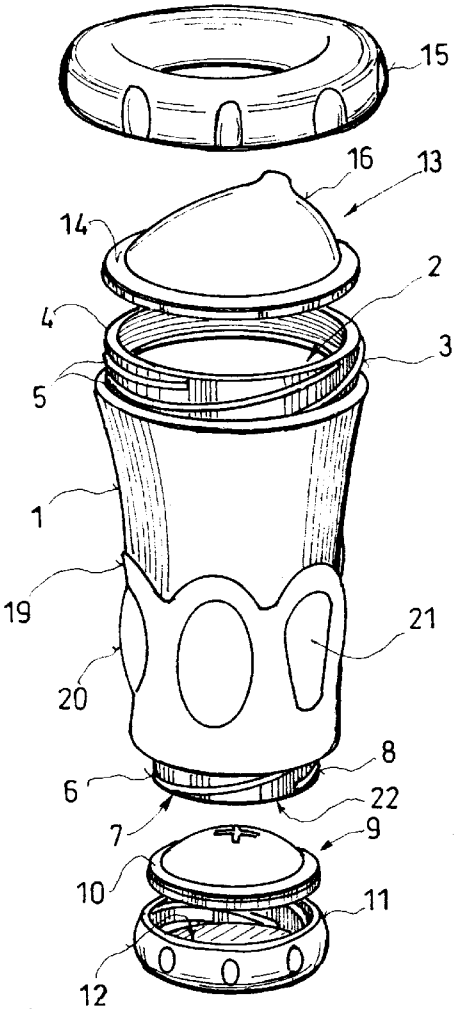
Figure 5:
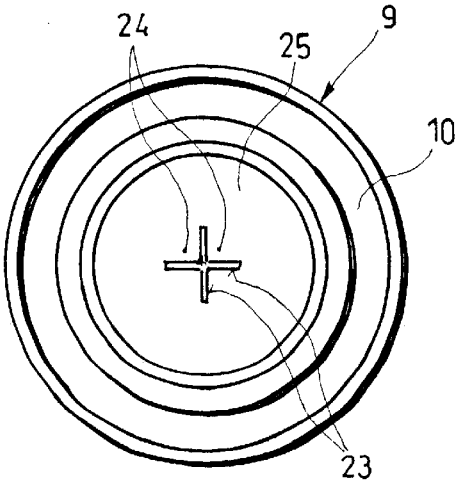
FIGS. 5 to 8 are plan views and side elevations of the parts forming the bottom of the bottle, i.e. a check-valve body and a fastener ring.

A baby's bottle according to FIG. 1 comprises a substantially cylindrical, tubular wall body 1. This body 1 may be formed by a clear plastic material, e.g. by a polycarbonate or an oriented polypropylene and is divergent in upward direction where it defines an opening 2 which is surrounded by a collar-like edge projection 3. This projection 3 has a, relative small, front edge surface 4 and a thread 5 on its circumferential surface. In a similar way, the body 1 comprises a lower collar-like projection 6 having a lower, ring-shaped front surface 7 and an outer thread 8 on its circumferential surface. A valve insert 9 to be described below with reference to FIGS. 5 and 7 has an outer rim or flange 10, the upper surface of which is to be sealingly engaged by the lower front surface 7 of the collar 6. In order to press this rim 10 against the lower front surface 7, a bottom ring 11 to be described below with reference to FIGS. 6 and 8 has an inner thread to be screwed onto the outer thread 8 of projection 6. The bottom ring 11 has a substantially flat bottom wall 12 forming the base surface of the bottle when screwed on (FIG. 2).

Figure 3B:
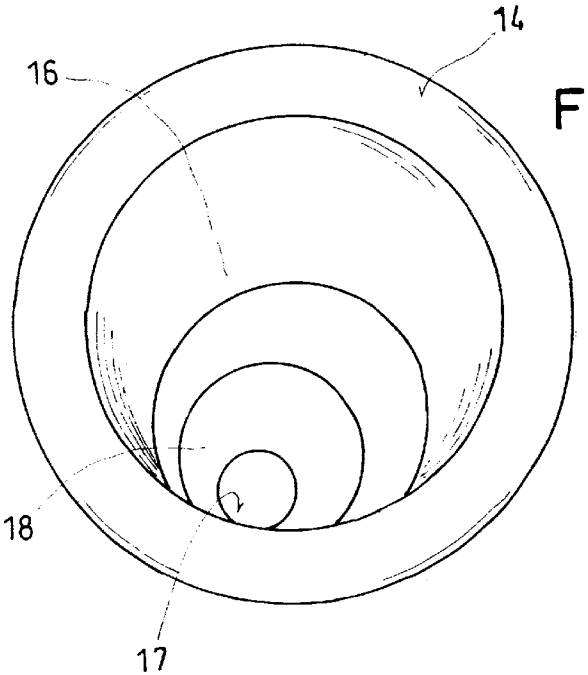
Figure 3A:
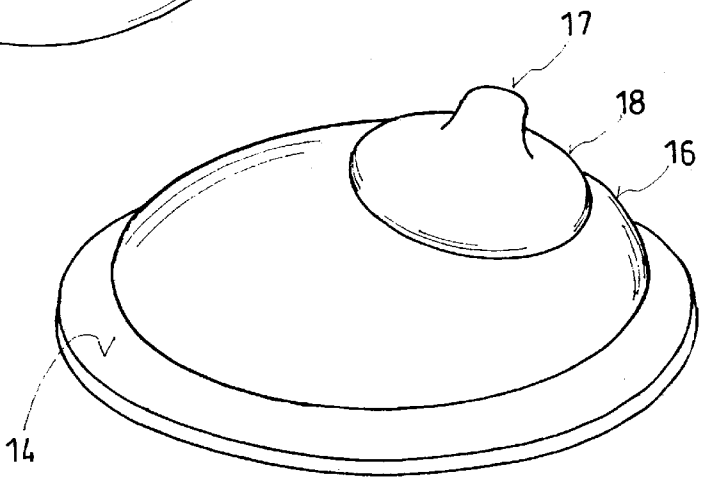
Figure 3C:
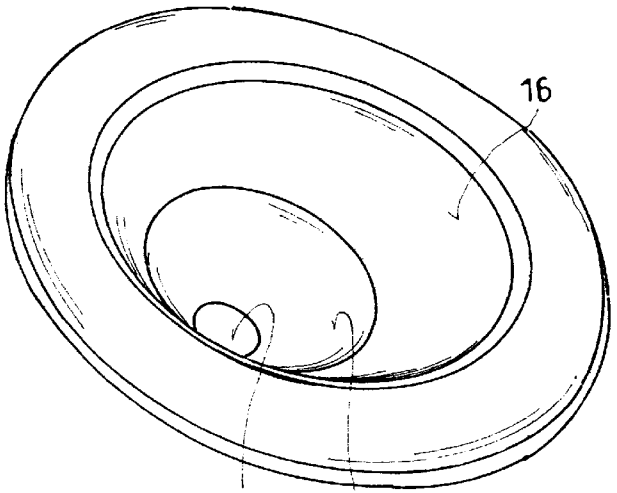
Figure 3D:
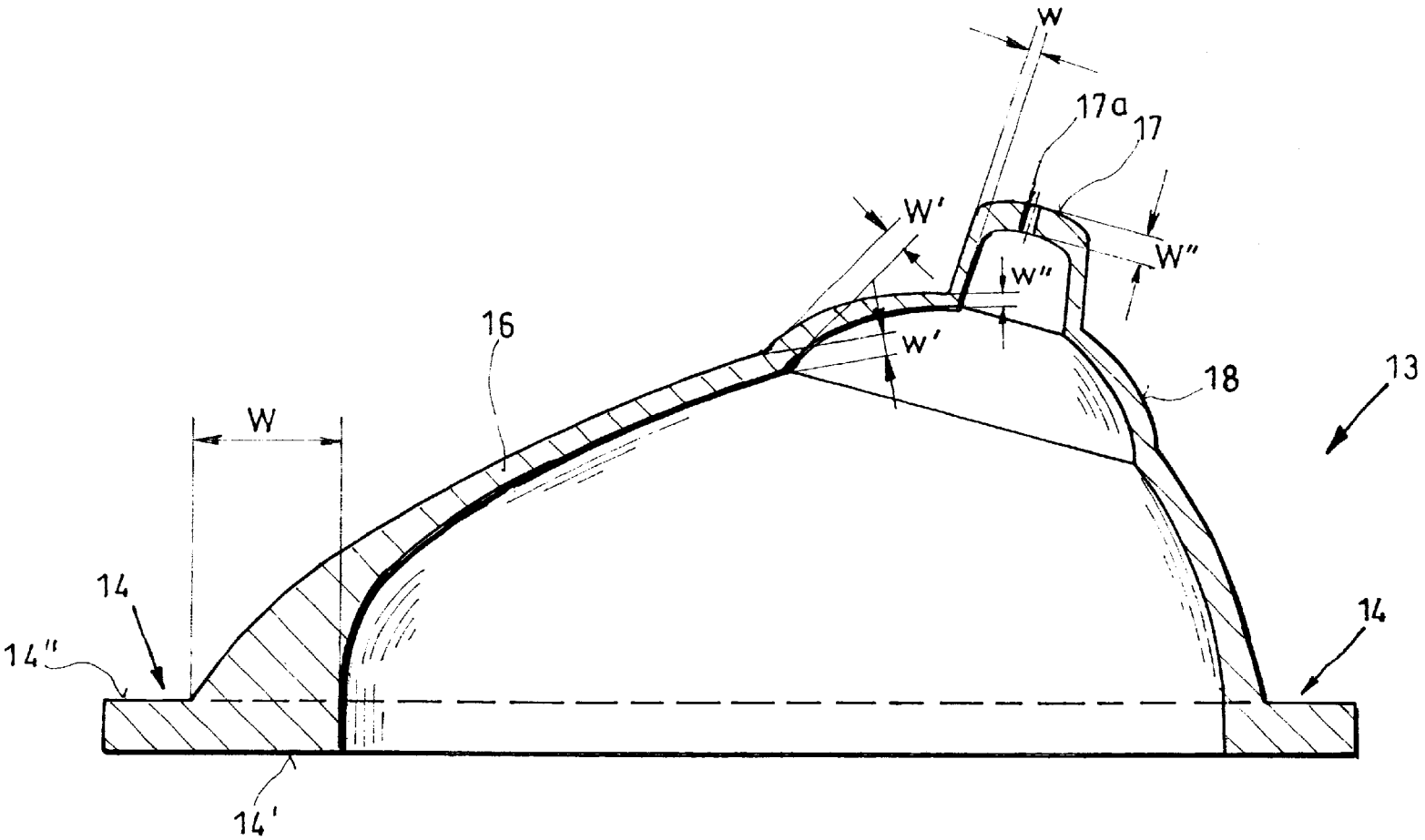
FIG. 3*d* shows an enlarged cross-section.

Similarly, a breast shaped nipple 13 has an outer sealing rim 14 including a lower sealing surface 14' and an upper sealing surface 14" (FIG. 3*d*), the lower front surface of which engages the upper front surface 4. Above the sealing rim 14 rises the cupola of a breast forming wall 16. A fastening ring 15, e.g. of a substantially rigid plastic material, such as a polypropylene material, has an inner thread to be screwed onto the outer thread 5 of projection 3 so as to press the rim 14 sealingly against the upper front surface 4 of the wall body 1, while leaving an opening large enough to allow the breast wall 16 to pass through when assembled (FIG. 2). As can be seen in greater detail in FIGS. 3*a* to 3*d*, this breast wall ends up in a nipple portion 17, having at least one sucking hole in it, on the so-called areola portion 18 slightly bulging out. In a mother's breast, the milk glands are about in the region of the areola 18 which is seized by baby's palate, and there is a plurality of small channels which lead outwards. Similarily, the nipple portion 17 can be formed with several openings (only one opening 17*a* is shown in FIG. 3*d*), e.g. by laser boring. It is apparent that the divergence of the walls of body 1 widens the opening 2 so that a full- scale breast forming wall can be attached to the opening 2 which leads into the interior or cavity of the wall body 1. In this way, a baby can suck from a breast-shaped nipple which conforms in shape to the baby's palate.

Alternatively (if another shape of a bottle's nipple is chosen) or preferably in addition to the above-mentioned breast-shaped nipple 13, at least part of the nipple 13, i.e. at least the nipple portion 17 and/or the areola 18, but preferably the whole breast-shaped nipple 13 is made of a material which is able to be stretched at least twice in dimension under a tension corresponding to a suction force of at least 130 mm Hg. This is based on findings what elasticity a human breast has, i.e. to be stretched at least about twice, at a suction force exerted ordinarily by a baby, i.e. at least 130, but in most cases no more than 200 mm Hg. The usual force is between 150 mm Hg and 200 mm Hg. Such material may be found among the thermo-elastomers, as mentioned above. A preferred material is a combination of a plastic material, such as urea, with a colloid or gel. It is known, for example, that such a gel is combined with 1,3-bis-(4-aminochinaldin-6-yl)-urea for forming a spongy material which is used in dentistry. A particularly preferred gel combination is sold by TekSource, Draper UT 84020, under the brand name Gelastic. This material can also be used as the valve member 9.

To enhance elastic deformation of the bottle nipple 13 in a manner quite similar to that of a human breast, it is suitable to confer it a wider wall thickness W (FIG. 3*d*) in the region of the lower sealing surface 14', and, generally, to decrease this thickness toward the nipple portion 17 so as to have a relative small thickness w in this region with exception of the top where the hole 17*a* is provided. Preferably, this decrease in thickness is made in steps, as shown in FIG. 3*d*. This means that each portion 16 and 18 of the bottle nipple 13 starts with its thickest section W or W', and ends in a thinner wall section w' or w" at its end. In this way, the thicker wall sections aid in avoiding collapsing. Collapsing can even be better avoided, if, for example, the thicker wall section W' is thicker, and in some cases significantly thicker, than the immediately adjoining (previous from bottom to top) thin wall section q'. From the assymmetry of the breast-shaped nipple 13 according to FIG. 3*d*, it will be clear that the thickness along the perimeter, say the thickness W or W' will normally be also assymmetric, but, if desired, can also be made symmetric in such a way that the thickness W, for example, is the same at right and at left of FIG. 3*d*. It is only the nipple portion 17 which has the thin wall thickness w at its lower end (for stretching) and its wider wall section W" at top. Certainly, it would be possible to make the rounding of portions 16 and 18 more flush, the areola portion 18 not bulging out in such a pronounced way. In such a case, it would be possible to have a wall which starts with thickness W and ends, at least substantially, with thickness w". In all cases, the thinner wall sections w, w' and w" enhance stretching of the respective regions. It is also clear according to FIG. 3*d*, that W>W', and, preferably, w'>w".

Figure 4:
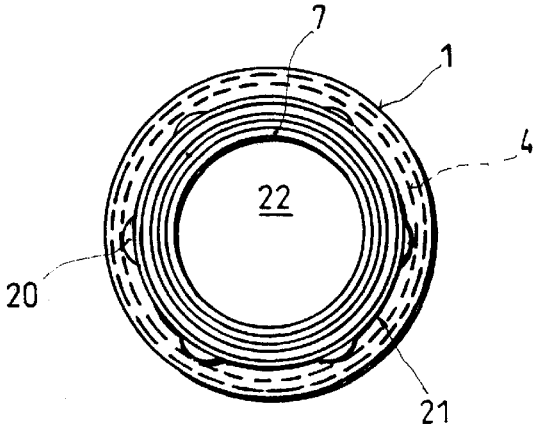
FIG. 4 is a bottom view according to arrow IV of FIG. 2.

The same or a similar material, as discussed above, can be used for forming an elastic grip ring on the outer surface of the transparent wall body 1. This grip ring 19 has either an annular or, as shown, a series of annularly distributed elastic bulges 20 distributed, according to FIG. 4, in a substantially hexagonal shape. There is at least one exception in that one bulge is omitted to provide an opening 21 (see FIGS. 1 and 2) through which the level of the liquid inside the bottle body 1 can be surveyed. If the bottle 1 is gripped below the elastic bulges 20 any slippage between the bottle and the hand will provoke that the bulges 20 are pressed from below and bulge more in upward direction, thus forming a stop against further slippage. Moreover, some babies like to grip the bottle and elastic feeling of the bulges comforts them. Therefore, it is not necessary to have only one ring of bulges, but more than one can also be provided over the axial length of the body 1. The advantage of using a thermo-elastic material is that it can easily be co-injection molded together with a polycarbonate or an oriented polypropylene so that it adheres firmly to the outer surface of the wall body 1. On the other hand, since this wall body 1 is made of a relative rigid material and is substantially cylindrical leaving and defining the opening 2 as well as a bottom opening 22 (FIG. 4), it is easy to clean because there are no recesses or projections inside and the inner surface is totally smooth.

The use of a material on the base of a gel has the further advantage that the bulges 20 can be made full or massive rather than hollow so that manufacture, particularly by co-injection molding, is facilitated. The grip ring 19 or covering can, of course cover the wall body 1 over its full axial length, but this is less desirable, particularly if the walls diverge in upward direction, as shown. Even if the bulges 20 (or a bulging toroidal ring) are hollow, e.g. by blowing air into them during injection molding, it is preferred if the grip ring 19 is fixed to the wall body 1 at least along its upper and lower circumference.

When a baby sucks milk from a bottle, it exerts a certain sucking force. However, as liquid is removed, a vacuum or subpressure is created inside the bottle that balances more and more the suction force of the baby and prevents further sucking. Therefore, the prior art, such as U.S. Pat. No. 5,699,921, suggested the use of a check-valve which can be formed by elastic lips. In the afore-mentioned U.S. Patent two opposing lips are provided which open under a certain inner vacuum of the bottle to let air in. As particularly may be seen from FIG. 4 of this patent, the two lips close tightly in the two directions they are bent, but the patent remains mute as to lateral sealing between the two lips. Moreover, arranging two lips in the manner shown and described there means that there are always some recesses and corners which can hardly kept clean.

The valve member 9 according to the present invention has a dome-like configuration formed by a dome wall 25 and having at least three, in the present embodiment four, crossing slots 23. It is contemplated that even more slots could be provided, such as six slots. More than six, however, may lead to sealing difficulties, because the flaps or tongues 24 defined by the slots 23 become weaker when more slots are provided and tend to engage the edge of the adjacent flap less reliably. In any case, due to the fact that the dome wall 25 bulges upwards, the flaps 24 are held tightly together as long as a positive force, such as the weight of the liquid, presses them downwards. However, they open easily as soon as there is a negative pressure inside the bottle 1. This elasticity is a reason why it is preferred to use the same material as is used for the nipple 13.

Figure 6:
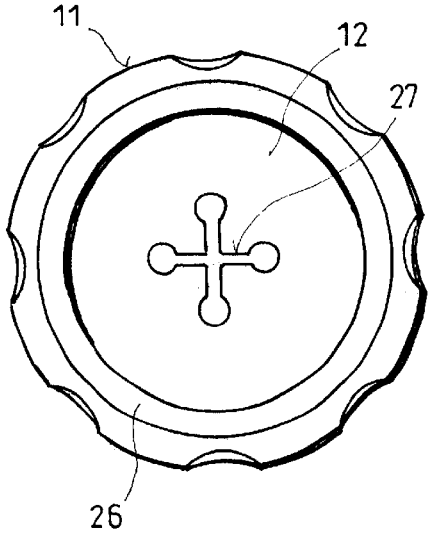
Figure 7:
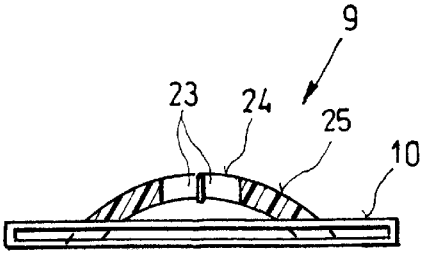
Figure 8:
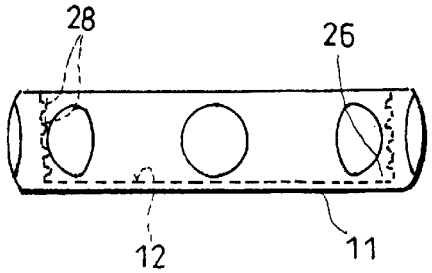
Figure 9:
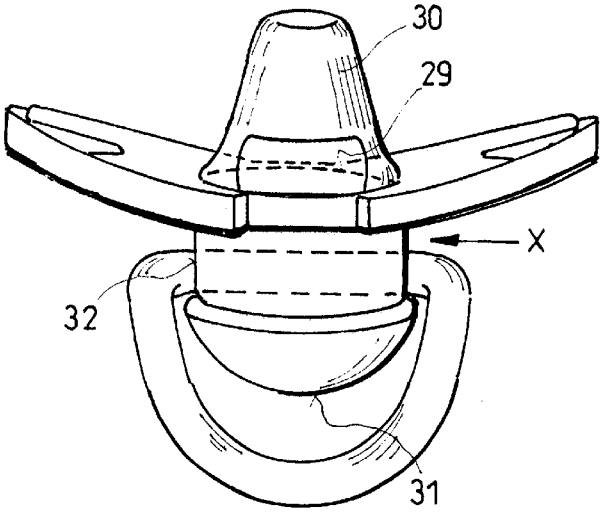
FIGS. 9 to 12 illustrate a pacifier according to the invention in a front view, a side view, partly in cross-section, corresponding to arrow X of FIG. 9, and two perspective views.

As has been mentioned previously, the upper surface of the sealing rim 10 is pressed against the lower front surface 7 (FIGS. 1 and 4) of the cylindrical projection 6. This is done by the bottom ring 11 and its bottom wall 12. As shown in FIG. 6 and in FIG. 8 in dotted lines, the bottom wall 12 may have an annular step 26 the upper surface of which forms a sealing surface which presses against the lower surface of the rim 10 (FIG. 7). This, however, is not necessary, and the bottom wall 12 can be flat also in the interior of the bottom ring 11. In order to allow access of air to the valve member 9 and its slots 23, the bottom wall 12 has a cut-out 27 (FIG. 6), but it should be understood that neither the shape of such cut-out is critical nor where it is arranged. Access of air could also be provided by any opening or channel and could likewise be formed in the peripheral wall of the bottom ring 11. As is indicated in dotted lines, the inner peripheral wall surface of this ring 11 is provided with a thread 28 which is to engage the outer thread 8 of projection 6 (FIG. 1).

Figure 10:
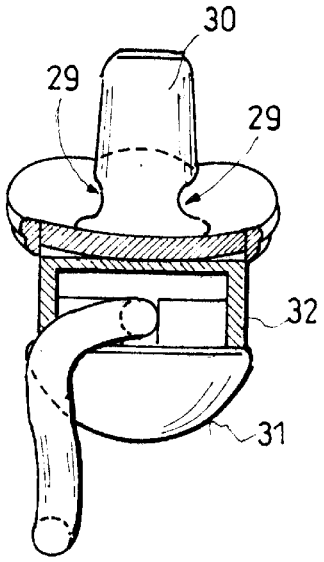
Figure 12:
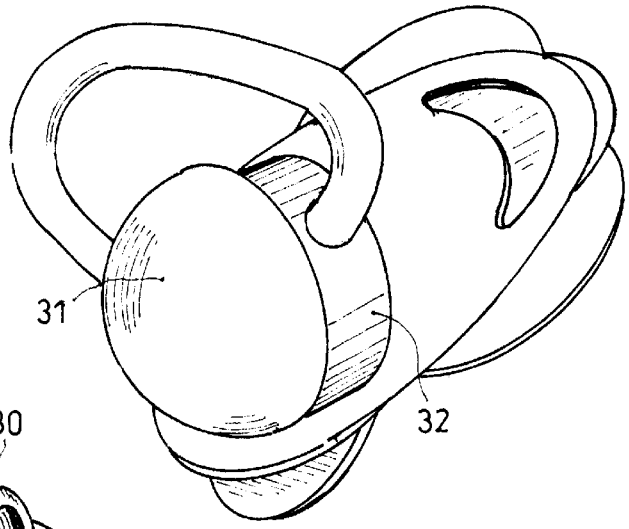
Figure 11:
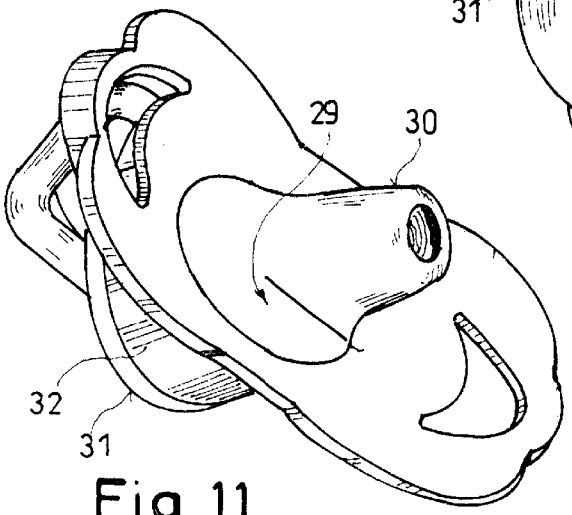

It has been mentioned above that a baby uses a special sucking technique when breastfed. It is useful not to accustom a baby to a different technique when sucking on a pacifier. Therefore, a pacifier according to the invention, as depicted in FIGS. 9 to 12, uses suitably the same material as defined above, i.e. a material that is able to be stretched at least twice in dimension under a tension corresponding to a suction force of at least 130 mm Hg. As in the case of the bulges 20, a pacifier's nipple portion may be massive or full rather than hollow as it is the case with customary pacifiers. Moreover, FIG. 10 shows that it is preferred to have at least one recess 29 behind a freely projecting head portion 30, the recess 29 facilitating retaining the pacifier in the baby's mouth. This head portion, if made from one of the materials mentioned above can be stretched at least twice when the baby sucks it in, thus imitating the properties of a human breast nipple. In this case, it could be solid or full material that forms the head portion 30.

Alternatively, it would be possible to provide a hole in the free end of the head portion and to provide a cavity inside the head portion which communicates with the hole. In this way, health promoting substances could be filled into the cavity, e.g. by making a hat-shaped end portion 31 screwable on a cylinder 32 to provide access to such a cavity.

Figure 14:
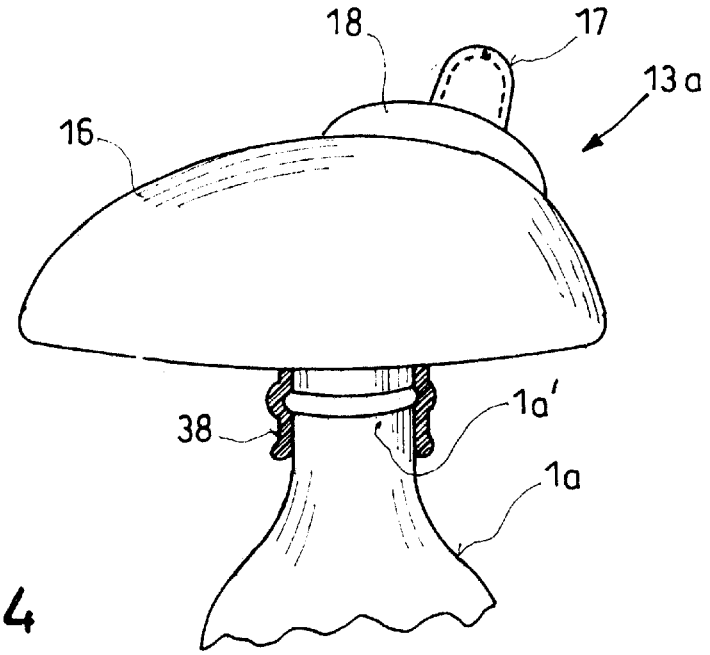
FIG. 14 shows an alternative combination of a breast-shaped nipple and the upper neck end of a baby's bottle.
Figure 13:
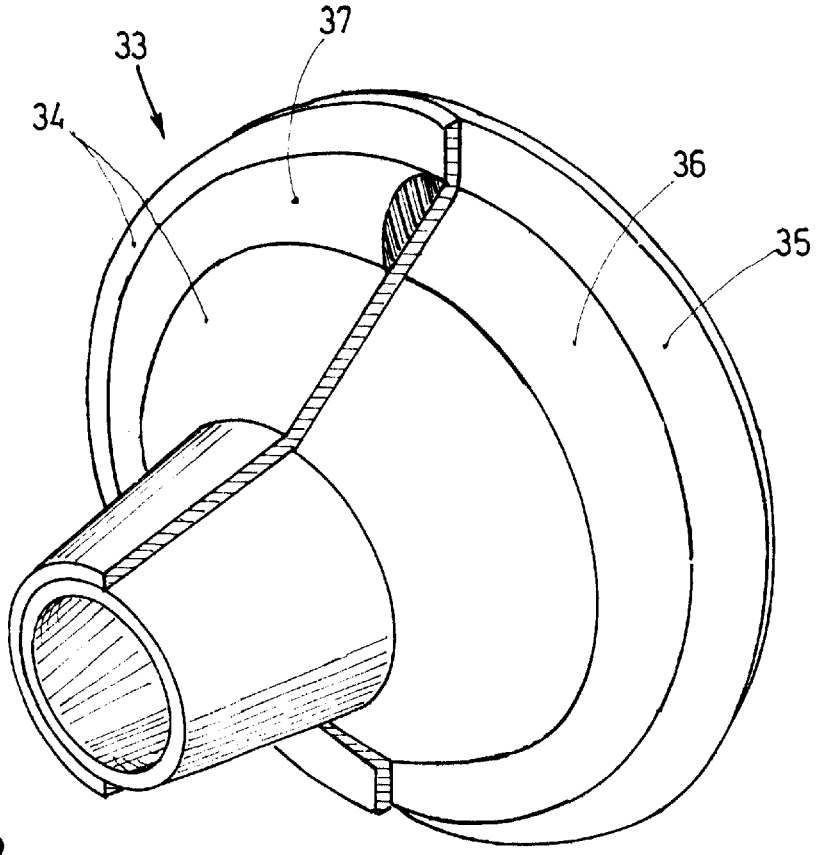
FIG. 13 represents a perspective view, partially in cross-section, of a breast hood formed according to the invention.

FIG. 13 shows a layered breast hood 33 comprising a relative hard and smooth outer layer 34, e.g. of a polycarbonate, and an inner layer 35 of one of the above-mentioned thermo-elastics or Gelastic material. The advantage of such an inner layer 35 resides in its elasticity, on the one hand, and its characteristics similar to human skin, thus giving a good feeling. Moreover, the two layers 34, 35 can be formed simultaneously by co-injection molding. Preferably, the inner layer 35 comprises a bulge 36 protruding into the interior of the hood 33. This bulge needs not necessarily to have a continuous annular shape as shown and preferred, but can be formed by a series of protrusions, preferably arranged as a ring. Furthermore, it may be seen that the annular bulge 36 is near the widened open end of the hood 33, as is preferred. However, it could be arranged more inwardly, say about half way of the conical part of the hood 33. The reason is that such bulge may have two functions. On the one hand, it seals the hood 33 against the female breast, while, on the other hand, exerting a massage effect onto the skin (similar to sucking of a baby) which is enhanced by the particular elasticity of the material. In order to make this massage effect more similar to a baby's sucking, the annular bulge 36 can be arranged more inwardly so that it imitates the baby's mouth surrounding the portion 18 (see FIGS. 1, 2 and 14). An outer bulge 37 may surround the outer layer 34, but in this case the choice of a soft, resilient material is not critical, since it serves only to facilitating gripping of the hood 33. This outer bulge 37 can either be slipped over the outer layer 34 (which may have a groove for receiving the base of the bulge 37) or can be co-injection molded as will preferably be the inner layer 35. It is clear that the hood 33 may comprise more than two layers, but in any case the inner layer should be structured as described above. FIG. 14 shows an alternative to FIGS. 1 to 3*c* where, although the bottle nipple is breast-shaped as shown, it fits to a customary baby's bottle la with a relative narrow neck portion 1*a*' (only the upper part is illustrated). To this end, the lower surface of the breast-shaped bottle nipple 13*a* extends inwardly to an elastic connection piece 38 (of a size as in available bottle nipples) which may be drawn over the neck portion 1*a*'. The advantage of this modification is that no special bottle is necessary, while some drawback may be seen in the fact that the relative large breast-shaped upper portion is more unstable in position.

What is claimed is:

1. An article intended to be contacted with a baby's mouth when sucking, the article comprising means forming a wall having a surface at least at one side, at least part of said surface including a material being able to be stretched at least twice in dimension under a tension corresponding to a suction force of at least 130 mm Hg.

2. Article as claimed in claim 1, wherein said suction force corresponds to at least 150 mmHg.

3. Article as claimed in claim 1, wherein said suction force corresponds to 200 mm Hg in maximum to stretch said material to twofold of its original dimension.

4. Article as claimed in claim 3, wherein said suction force corresponds to 150 to 200 mm Hg.

5. Article as claimed in claim 1, wherein said wall means are made entirely of said material.

6. Article as claimed in claim 1, wherein said material is a thermo-elastic material.

7. Article as claimed in claim 1, which is formed as a pacifier's nipple.

8. Article as claimed in claim 7, wherein said pacifier's nipple is made entirely of said material without any cavity.

9. Article as claimed in claim 1, which is formed as a baby's bottle nipple.

10. A baby's bottle nipple comprising fastening means including a sealing surface to be fastened on a baby's bottle, means forming a wall to be contacted with the baby's mouth, said wall having at least one opening to allow milk to pass through, said wall means being formed in the shape of a mother's breast including a nipple portion, said at least one opening being provided in said nipple portion; and said wall means are formed by a material being able to be stretched at least twice in dimension under a tension corresponding to a suction force of at least 130 Hg.

11. Nipple as claimed in claim 10, where in said wall means have a wider wall thickness in the region of said sealing surface, and substantially decrease in thickness toward said nipple portion.

12. Nipple as claimed in claim 11, wherein said decrease is in steps.

13. Nipple as claimed in claim 12, wherein said wall means form a basic portion and an areola portion which bulges out from said basic portion, each portion starting with the thickest wall section and ending with a thinner wall section.

14. A breast hood to be connected to a milk pump, said breast hood comprising wall means forming an outer surface and an inner surface, said inner surface being substantially conical so as to have a wide opening end for engaging a female breast, and a small opening end, said outer surface being of a first, relative rigid material, while said inner surface is of a thermo-elastic material.

15. Breast hood as claimed in claim 14, wherein said thermo-elastic material has an elasticity to render it able to be stretched at least twice in dimension under a tension corresponding to a suction force of at least 130 Hg.

16. Breast hood as claimed in claim 14, wherein said first and second materials are co-injection molded.

17. Breast hood as claimed in claim 14, wherein said inner surface has at least one inner protruding bulge.

18. Breast hood as claimed in claim 17, wherein said bulge is annular.

19. Breast hood as claimed in claim 17, wherein said bulge is arranged near said wide opening end.

20. A baby's bottle comprising wall means having an inner surface of a first, rigid material surrounding a cavity to be filled with liquid, said inner surface defining an opening surrounded by an edge of said wall means and leading out of said cavity; and an outer surface to be gripped, said outer surface being made at least in part from a second material having a predetermined elasticity and bulging out from said first, rigid material.

21. Baby's bottle as claimed in claim 20, wherein said second material covers only a portion of said first material.

22. Baby's bottle as claimed in claim 21, wherein said first material is transparent and said second material has at least one opening to show the level of said liquid.

23. Baby's bottle as claimed in claim 21, wherein said second material covers that portion of said first material which is distant from said edge.

24. Baby's bottle as claimed in claim 20 wherein said first and second materials are co-injection molded.

25. Baby's bottle as claimed in claim 20, wherein said material is a thermo-elastic material.

26. A combination of a baby's bottle and an assigned nipple, the combination comprising a baby's bottle including first wall means surrounding a cavity to be filled with liquid, an opening of a predetermined size surrounded by an edge of said wall means and leading out of said cavity to receive said nipple;

the nipple including fastening means to be fasten ed on a baby's bottle, and second wall means to be contacted with the baby's mouth, said second wall means having at least one opening to allow milk to pass through, being formed in the shape of a mother's breast of a predetermined circumference and including a nipple portion, said at least one opening being provided in said nipple portion; and said second wall means are formed by a material being able to be stretched at least twice in dimension under a tension corresponding to a suction force of at least 130 Hg.

27. Article as claimed as in claim 26, wherein said first wall means are made of at least two layers.

28. Article as claimed in claim 27, wherein said at least two layers comprise an inner layer of a relative unstretchable material and an outer layer of stretchable material.

29. Combination as claimed in claim 26, wherein said predetermined size corresponds substantially to said predetermined circumference.

30. Combination as claimed in claim 26, wherein said first wall means are substantially cylindrical and have a circular cross-section.

31. Combination as claimed in claim 26, wherein said first wall means are diverging towards said opening.

32. Combination as claimed in claim 26, wherein said first wall means comprise an inner surface substantially without any recess and projection.

* * * * *

UNITED STATES PATENT AND TRADEMARK OFFICE

CERTIFICATE OF CORRECTION

PATENT NO. : 6,253,935 B1
DATED : July 3, 2001
INVENTOR(S) : Timothy Pinckney Fletcher It is certified that error appears in the above-identified patent and that said Letters Patent is hereby corrected as shown below:

Column 1,
Line 12, "breasffeeding" should be -- breastfeeding --.
Line 54, "breasffeeding" should be -- breastfeeding --.

Column 4,
Line 52, "w" should be -- *w* --
Line 57, "w"' and "w"" should be -- *w'* -- and -- *w"* --.
Line 62, "q"' should be -- *w'* --.

Column 5,
Line 2, "w" should be -- *w* --.
Line 8, "w, w' and w"" should be -- *w, w'* and *w"* --.
Line 10, "w'>w"" should be -- *w'>w"* --.

Column 7,
Line 66, "where in" should be -- wherein --.

Column 8,
Line 66, "fasten ed" should be -- fastened --.

Signed and Sealed this

First Day of October, 2002

*Attest:*

*Attesting Officer*

JAMES E. ROGAN
*Director of the United States Patent and Trademark Office*